United States Patent [19]

Banker et al.

[11] 4,252,564

[45] Feb. 24, 1981

[54] METHOD FOR CLEANING BOMB-REDUCED URANIUM DERBIES

[75] Inventors: John G. Banker, Boulder, Colo.; Hubert L. Wigginton, Oak Ridge, Tenn.; David E. Beck; Cressie E. Holcombe, both of Knoxville, Tenn.

[73] Assignee: The United States of America as represented by the United States Department of Energy, Washington, D.C.

[21] Appl. No.: 68,358

[22] Filed: Aug. 21, 1979

[51] Int. Cl.[3] ..... C22B 60/02

[52] U.S. Cl. ..... 75/84.1 R; 75/84.4

[58] Field of Search ..... 75/84.1 R, 84.4

[56] References Cited

U.S. PATENT DOCUMENTS

| | | | |
|---|---|---|---|
| 3,088,827 | 5/1963 | Mayoteaux | 75/84.1 R |
| 3,140,171 | 7/1964 | Trapp | 75/84.1 R |
| 3,148,977 | 9/1964 | Teitel | 75/84.1 R |
| 3,290,147 | 12/1966 | Duxbury | 75/84.1 R |
| 3,322,679 | 5/1967 | Kamemoto et al. | 75/84.1 R |
| 3,709,678 | 1/1973 | Helary et al. | 75/84.1 R |
| 3,850,623 | 11/1974 | Sheller | 75/84.1 R |
| 3,985,551 | 10/1976 | Powell et al. | 75/84.1 R |

OTHER PUBLICATIONS

Harrington, C. D. et al., Eds. "Uranium Production Technology", pp. 245–270, Van Nostrand Co., Princeton, N.J., 1959.

*Primary Examiner*—Richard E. Schafer

*Attorney, Agent, or Firm*—James E. Denny; Stephen D. Hamel; Earl L. Larcher

[57] ABSTRACT

The concentration of carbon in uranium metal ingots induction cast from derbies prepared by the bomb-reduction of uranium tetrafluoride in the presence of magnesium is effectively reduced to less than 100 ppm by removing residual magnesium fluoride from the surface of the derbies prior to casting. This magnesium fluoride is removed from the derbies by immersing them in an alkali metal salt bath which reacts with and decomposes the magnesium fluoride. A water quenching operation followed by a warm nitric acid bath and a water rinse removes the residual salt and reaction products from the derbies.

6 Claims, 2 Drawing Figures

METHOD FOR CLEANING BOMB-REDUCED URANIUM DERBIES

BACKGROUND OF THE INVENTION

Uranium metal is conventionally produced by reducing uranium tetraflouride ($UF_4$) with magnesium, often with magnesium fluoride slag liners. This reduction of the uranium provides a product commonly referred to as a regulus or derby of uranium metal which has a crust of magnesium fluoride adhering to the derby surface. The derbies from the reduction operation are remelted into ingots by induction casting. Prior to the induction casting of a derby the crust or slag including the magnesium fluoride was supposedly removed from the derby surface by mechanical means such as chipping, thermal shocking, grit blasting, and the like.

The casting operation was previously achieved by melting the derby in a graphite crucible. A reaction occurs between the molten uranium and the graphite that introduces considerable carbon in the ingot. Therefor, since in many instances carbon concentrations greater than about 100 ppm were found to be undesirable, the graphite crucibles used in the casting operation were provided with a surface coating of yttria or zirconia which are essentially non-wettable by molten uranium. With such an yttria or zirconia coating uranium derbies which have a carbon content of about 25 ppm could be cast into ingots with the carbon content increasing to only about 75 ppm carbon which is well within the 100 ppm limitation.

During the course of analyzing ingots from casting procedures utilizing yttria or zirconia coated graphite crucibles, it was discovered that several ingots contained carbon in concentrations considerably greater than 100 ppm. It was determined that residual magnesium fluoride on the surface of the uranium derbies reacted with the coatings on the graphite crucible resulting in a breakdown of the coating so as to expose the underlying graphite to molten uranium. This exposure of the graphite resulted in reactions with the molten uranium so as to contaminate the uranium with carbon concentrations greater than 100 ppm. A suitable solution or technique was needed for removing the magnesium fluoride from the uranium derbies prior to the induction casting of the ingots to inhibit the breakdown of the crucible coatings. Several techniques previously used for removing the magnesium fluoride from the uranium derbies suffered shortcomings or drawbacks. For example, the forming of an oxide layer on the uranium surface by heating the derbies in air and then water quenching the derbies so as to remove both the oxide and the magnesium fluoride layers by thermal shocking was found to result in excess oxidation of the uranium. As pointed out above, other techniques for cleaning the surface of the uranium derbies such as chipping and grit blasting left sufficient residual magnesium fluoride on the derby to react with the crucible coatings. Also, the use of a warm nitric acid bath did not remove the residual magnesium fluoride from the surface of the uranium derbies.

BRIEF SUMMARY OF THE INVENTION

Accordingly, it is the primary objective or goal of the present invention to substantially minimize or obviate the above and other problems associated with the casting of bomb-reduced uranium metal. The objective of the invention is to provide a method for removing residual magnesium fluoride from the surfaces of the uranium derbies prior to the casting operation so as to minimize or inhibit the destruction of the yttria or zirconia coatings on the graphite crucibles used in the casting operation. The method of the present invention for achieving this objective comprises the immersing of the uranium derby after excess slag has been removed by conventional chipping and blasting procedures into an alkali metal salt bath at a temperature greater than about 500° C. This molten salt bath effectively decomposes the magnesium fluoride on a surface of the uranium derby. After a sufficient duration the derby is removed from the bath and quenched in a water bath so as to remove the salt and the decomposition products from the surface of the article by thermal shocking. The derby is then washed in a warm solution of nitric acid to remove any residual salt from the surface of the articles. As in previous practices the uranium article may then be rinsed with water to remove the nitric acid. The uranium derby after being so treated is essentially free of surface impurities which would be reactive with the yttria or zirconia coatings on the induction casting crucibles.

Other and further objects of the invention will be obvious upon an understanding of the illustrative method about to be described or will be indicated in the appended claims, and various advantages not referred to herein will occur to one skilled in the art upon employment of the invention in practice.

Figure 1:
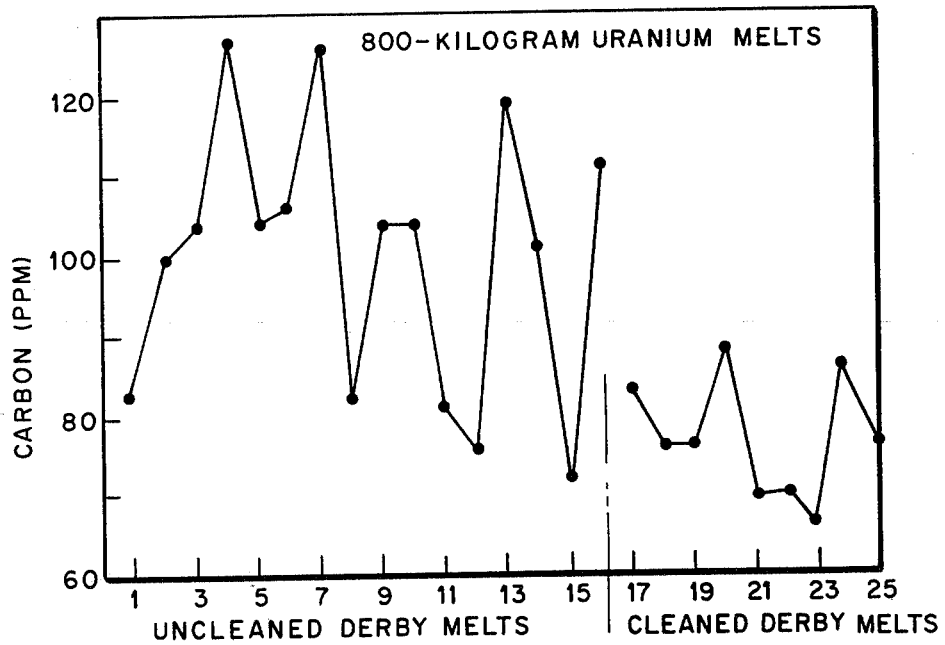
FIG. 1 is a graph illustrating and comparing the carbon contents of several 800-kilogram ingots of uranium which were induction cast in yttria-coated graphite crucibles from derbies cleaned by practicing the subject method and derbies which possessed excess residual magnesium fluoride on the surfaces thereof.
Figure 2:
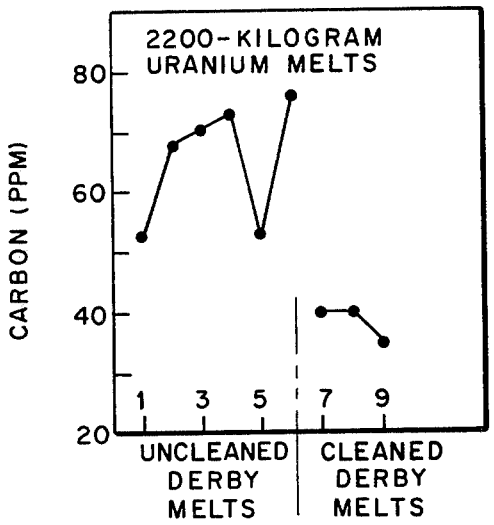
FIG. 2 is a graph similar to that of FIG. 1 but relating to 2200-kilogram ingots of uranium prepared from induction casting of derbies cleaned by the subject method and unclean derbies.

The graphs have been chosen for the purpose of illustration and description. The graphs illustrated are not intended to be exhaustive or to limit the invention to the precise carbon levels disclosed. They are chosen and described in order to best explain the principles of the invention and their application in practical use to thereby enable others skilled in the art to best utilize the invention in various method steps and modifications thereof as are best adapted to the particular use contemplated.

DETAILED DESCRIPTION OF THE INVENTION

As briefly pointed out above, uranium metal derbies prepared by the bomb reduction of uranium tetrafluoride and magnesium (often in the presence of magnesium fluoride slag liners) resulted in the presence of some residual magnesium fluoride on the surface of the derbies even after practicing conventional techniques for removing such impurities from the surface of the derbies. The presence of this excess of residual magnesium fluoride has been found to be deleterious to the production of vacuum-cast uranium ingots with a carbon content less than 100 ppm. The reaction between the magnesium fluoride and the yttria or zirconia coating on the graphite crucible utilized in the vacuum-casting operations results in a coating breakdown to expose the underlying carbon to the molten uranium. The reaction between the molten uranium and the graphite causes carbon to be induced into the uranium melt at a level considerably greater than desired for many applications.

The method of the present invention is practiced on bomb-reduced uranium derbies which contain residual uranium on the surfaces thereof prior to casting ingots from the derbies. To practice the present invention the uranium derby is immersed in a liquid alkali metal salt bath for a sufficient duration to allow the salt to react with and decompose the magnesium fluoride. The alkali metal salt bath utilized in the present invention is preferably a bath having a melting point less than 600° C. such as provided by a eutectic composition of 35 wt.% lithium carbonate ($Li_2CO_3$) and 65 wt.% potassium carbonate ($K_2CO_3$). The bath temperature is preferably maintained as low as practical for safety purposes, e.g., inhibiting explosion, during the water quenching of the derbies and also to inhibit oxidation of the hot derbies. The dissolving of the fluoride in a bath results in a chemical reaction between the salt and the magnesium fluoride as follows:

$$MgF_2+Li_2CO_3 \rightarrow MgO+CO_2\uparrow+2LiF$$

The reaction produces a white froth on the surface of the salt bath which is believed to be magnesium oxide and $CO_2$.

While it is desirable to use a eutectic composition ± about 5 wt.% as the bath because of its lower melting temperature, in instances where higher temperatures are permissible, a bath of potassium carbonate and/or lithium carbonate in concentrations of 0 to 100 percent may be used. In a 50/50 molar ratio bath at about 600° to 650° C. of potassium carbonate and lithium fluoride it was found that the lithium fluoride was not necessary in the bath for decomposing the magnesium fluoride. This reaction with the potassium carbonate-lithium fluoride bath from X-ray analysis appeared to be $$3MgF_2+K_2CO_3 \rightarrow 2KMgF_3+MgO+CO_2\uparrow$$

After soaking the uranium derbies in the alkali salt baths for a duration sufficient to decompose essentially all of the residual magnesium fluoride on the surface of the derby, the derby is subjected to an immediate water quench to effect the removal of the salt and the decomposition products from the surface of the article. Normally, the time duration sufficient for decomposing the magnesium fluoride depends upon the quantity of magnesium fluoride present on the surface and also upon the particular bath composition being employed. With the eutectic lithium carbonate-potassium carbonate bath at a temperature of about 630° C. an immersion period of about one hour is normally sufficient for decomposing excess residual potassium magnesium fluoride on the surface of the uranium derby without effecting excessive waste of the uranium metal. The water bath, or quenching step, is achieved immediately after the soaking of the uranium derby in the salt bath. This quenching operation normally requires only a sufficient time to remove the reaction products from the surface of the derbies. After finishing the quenching step, the uranium derbies are preferably immersed in a warm solution (about 82° F.) of nitric acid, e.g., a 35–50 wt.% $HNO_3$ solution, to remove any remaining residual salt and reaction products from the surface of the article. Again after completing the acid rinsing step the uranium derbies are rinsed in water to remove the acid to provide a uranium derby virtually free of all impurities on the surface thereof with the coatings on the casting crucibles.

By practicing the present invention, weight loss of the uranium is only very minimal. In fact such weight losses are considerably less than that encountered by the thermal shocking step previously utilized to remove the impurities from the uranium derbies prior to the uranium casting. Upon completion of practicing the present invention, the uranium derbies can be vacuum cast into graphite crucibles coated with yttria or zirconia without encountering the deleterious coating breakdown heretofore caused by the presence of magnesium fluoride on the derbies.

In order to provide a more facile understanding of the present invention examples are set forth below relating to the melting of uranium derbies cleaned of residual magnesium fluoride by the present method and compared with the carbon content of ingots prepared from derbies which were not adequately cleaned of residual magnesium fluoride.

EXAMPLE I

Sixteen uranium ingots cast in yttria-coated graphite crucibles from derbies having residual magnesium fluoride on the surface thereof are shown in FIG. 1 and contain a mean of 101.1 ppm carbon. Nine similar castings were prepared from derbies subjected to the surface cleansing method of the present invention. Each of these nine derbies was soaked in a eutectic salt bath containing 35 wt.% lithium carbonate and 65 wt.% potassium carbonate at 630° C. for one hour. The nine derbies were then water quenched to remove a large portion of the salt and reaction products from the surface of the derbies. Any residual salt remaining on the derbies was then etched therefrom in a warm solution (82° C.) of 50% nitric acid for 15 minutes. The nitric acid was rinsed from the derby with demineralized water. As shown in FIG. 1, the nine cleaned derbies when induction cast had a mean carbon content of only 76.7 ppm.

EXAMPLE II

In another demonstration of the present invention eight derbies having residual magnesium fluoride impurities on the surface thereof were selected for comparison. Five of these derbies were vacuum cast with the residual magnesium fluoride thereon. These five castings had a mean carbon content of 66 ppm. The remaining three of the derbies were treated or cleaned as set forth in Example I. The melts had a mean carbon content of 38.3 ppm.

It will be seen that the high level of carbon induction cast ingots of uranium in uranium alloys produced from bomb-reduced derbies containing residual magnesium fluoride on the surface thereof is essentially eliminated by practicing the derby cleaning method of the present invention.

We claim:

1. A method for removing residual magnesium fluoride from the surface of a uranium derby prepared by the bomb reduction of uranium tetrafluoride in the presence of magnesium comprising the steps of:

immersing the derby into a bath of at least one alkali metal salt capable of reacting with and decomposing the magnesium fluoride on the surface of the derby, and quenching the derby in a water bath for removing the salt and reaction products from the surface thereof.

2. The method for removing residual magnesium fluoride from a derby of bomb-reduced uranium as claimed in claim 1 including the additional steps of:

washing the water-quenched derby in a warm solution of nitric acid for etching residual salt from the surface of the derby, and thereafter rinsing the acid-etched derby with demineralized water to provide a uranium derby with a surface essentially free of magnesium fluoride.

3. The method for removing residual magnesium fluoride from a derby of bomb-reduced uranium as claimed in claim 2 wherein the nitric acid is a warm solution of nitric acid and wherein the derby is maintained in the acid bath for a duration sufficient to remove the residual salt and reaction products.

4. The method for removing residual magnesium fluoride from a derby of bomb-reduced uranium as claimed in claim 1 wherein the alkali metal salt bath consists of a eutectic solution of lithium carbonate and potassium carbonate.

5. The method for removing residual magnesium fluoride from a derby of bomb-reduced uranium as claimed in claim 4 wherein the alkali metal bath is at a temperature greater than about 600° C. and wherein the uranium derby is immersed in the bath for a duration in excess of about one hour.

6. The method for removing residual magnesium fluoride from a derby of bomb-reduced uranium as claimed in claim 1 wherein the alkali metal salt bath comprises potassium carbonate and lithium carbonate in a concentration of 0 to 100 percent.

* * * * *